US005485387A

United States Patent [19]

Franke-Polz

[11] Patent Number: 5,485,387

[45] Date of Patent: Jan. 16, 1996

[54] METHOD AND APPARATUS FOR PERFORMING CUP EARING TEST

[75] Inventor: Eric M. Franke-Polz, Porter, Ind.

[73] Assignee: National Steel Corporation, Mishawaka, Ind.

[21] Appl. No.: 325,082

[22] Filed: Oct. 17, 1994

[51] Int. Cl.[6] ..... G06F 19/00

[52] U.S. Cl. ..... 364/472; 364/476; 364/506

[58] Field of Search ..... 364/472, 474.37, 364/551.02, 476, 506, 507, 551, 570, 552, 562, 565; 73/104; 250/223 B; 356/240; 209/522–524, 526; 72/347–349, 379.4; 33/522; 83/94; 420/534

[56] References Cited

U.S. PATENT DOCUMENTS

| | | | |
|---|---|---|---|
| 4,805,125 | 2/1989 | Beebe | 364/506 |
| 4,846,033 | 7/1989 | Uehlinger et al. | 83/94 |
| 5,110,545 | 5/1992 | McAuliffe et al. | 420/534 |

*Primary Examiner*—Paul P. Gordon

*Assistant Examiner*—Steven R. Garland

*Attorney, Agent, or Firm*—James L. Bean; Kerkam, Stowell, Kondracki & Clarke

[57] ABSTRACT

An apparatus and method for testing a drawn metal cup for earing, including using a sensing device operable to obtain a first data set representing the height of the rim portion of the cup by rotating the cup relative to the sensing device and recording rim height data each time the cup rotates a given number of degrees, generating a second data set which represents the first derivative of the first data set, and calculating the percent earing for the cup by using values in the first data set which correspond to zero-crossings in the second data set. The method further includes determining the number of peaks and valleys represented in the first data set by counting the number of zero-crossings in the second data set and, if the number of zero-crossings is less than the known minimum number of peaks and valleys on the cup, incrementally biasing the first data set in a manner which increases the detectability of the peaks and valleys and regenerating the second data set until the number of zero-crossings therein equals the known number of peaks and valleys on the cup.

25 Claims, 5 Drawing Sheets

METHOD AND APPARATUS FOR PERFORMING CUP EARING TEST

BACKGROUND OF THE INVENTION

1. Field of the Invention

The present invention relates to the field of metal packaging, and, more particularly, to an improved method and apparatus for performing caring tests on drawn metal parts, such as cups or the like.

2. Description of the Prior Art

The longstanding use of tinplate has been directed in recent years to the manufacture of drawn parts used in the production of metal cans or the like. This process demands constantly increasing performance from the materials employed. The geometric quality of a can depends to a large extent on the anisotropy of the tinplate used. One method of determining the anisotropic characteristics of steel in a manufacturing process is known as the "cup earing" test. An initial step in the production of metal cans involves blanking out circular disks from a sample steel sheet and drawing the circular disks into flat bottom cups. Numerous devices are known for drawing disks into flat bottom cups, as evidenced by U.S. Pat. Nos. 4,414,836 and 3,494,169 to Saunders.

When a disk is drawn or pressed, the resulting cup exhibits a wavy top portion. In other words, the upper rim of the drawn cup includes alternating high and low portions thereon, hereinafter referred to as peaks and valleys, respectively. This phenomenon, known as "earing", occurs as a result of the orientation texture of the material. A typical cup of double reduced material will exhibit four peaks and four valleys. A cup made from isotropic steel would exhibit no earing.

In order to perform a cup earing test, the height of each peak and valley is typically measured by hand using a dial indicator. The foot of the dial indicator is placed on the cup rim, and the cup is rotated through 360 degrees. As the cup is rotated, the peaks and valleys are visually detected and the corresponding height readings are recorded. A "percent earing" is then calculated using the peak and valley height readings.

There are several problems and disadvantages with this method. First, the hand measurement of the cup is a time intensive operation. Second, the visual detection of the peaks and valleys is subjective, inexact and leads to poor repeatability of measurements. Third, the cup may exhibit a "wedge" condition due to certain drawing and anisotropic conditions, which condition can obscure peak and valley measurements. A wedge condition exists on the cup rim when a valley measurement is higher than an adjacent peak measurement. The presence of a wedge condition significantly increases the difficulty in locating the peak and valley positions for use in performing an accurate percent earing calculation.

SUMMARY OF THE INVENTION

A primary object of the present invention is to provide an apparatus and method for enabling cup earing tests to be performed quicker and easier than has heretofore been achieved with prior art techniques.

A more specific object of the present invention is to provide an apparatus and method which enables more accurate cup earing tests to be performed.

A further object of the invention is to provide an apparatus and method for enabling precise determination of the location of all peaks and valleys on the cup being tested.

Another object of the invention is to provide an apparatus and method for enabling reliable cup earing tests to be performed even when the cup being tested exhibits a wedge condition.

Yet another object of the invention is to provide an apparatus and method which are capable of accurately locating all peaks and valleys on the cup being tested even when a wedge condition exists.

These and other objects and advantages are achieved by the present invention, which provides a method of testing a drawn metal cup for earing, including the steps of using a sensing device to obtain a first data set representing the height of the rim portion of the cup by rotating the cup relative to the sensing device and recording rim height data each time the cup rotates a given number of degrees, loading the first data set into an information processing device, generating a second data set which represents the first derivative of the first data set, and calculating the percent caring for the cup from the first data set by using values therein which correspond to zero-crossing values in the second data set.

In accordance with a preferred embodiment of the method of the present invention, the step of generating the second data set includes determining the number of peaks and valleys represented in the first data set by counting the number of zero-crossings in the second data set, and, if the number of zero-crossings is less than the known minimum number of peaks and valleys on the cup, generating a biased first data set by adding a biasing data set thereto which increases the detectability of the peaks and valleys therein, and regenerating the second data set to represent the first derivative of the biased first data set.

In accordance with another embodiment of the invention, the step of generating the second data set further includes the steps of repeatedly increasing the biasing factor to further increase the detectability of the peaks and valleys in the first data set, regenerating the biased first data set, and regenerating the second data set from the biased first data set, until the number of zero crossings in the second data set equals the known minimum number of peaks and valleys on the cup.

The apparatus of the present invention includes a sensing device operable to obtain a first data set representing the height of the rim portion of the cup at various locations thereon and an information processing device connected thereto, wherein the information processing device includes means for generating a second data set which represents the first derivative of the first data set, and means for calculating the percent earing for the cup from the first data set by using values therein which correspond to zero-crossing values in the second data set.

In accordance with a preferred embodiment of the present apparatus, the information processing device further includes means for determining the number of peaks and valleys represented in the first data set by counting the number of zero-crossings in the second data set, and means for generating a biased first data set, if the number of zero-crossings is less than the known minimum number of peaks and valleys on the cup, by adding a biasing data set thereto which increases the detectability of the peaks and valleys in the first data set, and means for regenerating the second data set to represent the first derivative of the biased first data set.

BRIEF DESCRIPTION OF THE DRAWINGS

Other objects and advantages of the subject invention will become apparent from a study of the following specification when viewed in light of the accompanying drawings, in which.

DETAILED DESCRIPTION OF THE PREFERRED EMBODIMENTS

Figure 1:
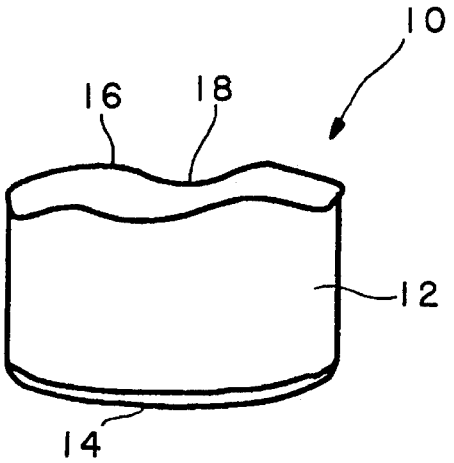
FIG. 1 depicts a drawn metal cup for use with the method and apparatus of the present invention.
Figure 2:
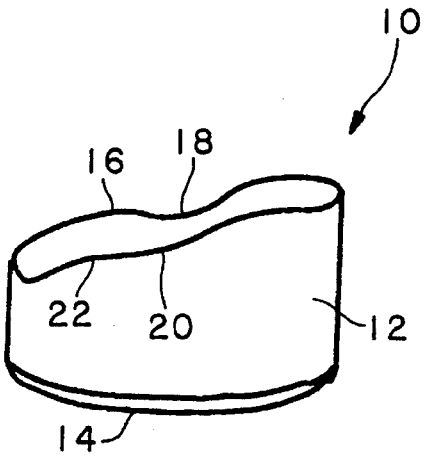
FIG. 2 depicts a drawn metal cup having a wedge condition for use with the method and apparatus of the present invention.

Referring now to the drawings wherein like numerals designate similar parts throughout the various views, and more particularly to FIGS. 1 and 2 thereof, the system and method of the present invention is designed for use in testing a drawn cup, designated generally by the numeral 10. The cup 10 includes a cylindrical sidewall 12 and a substantially flat bottom wall 14. Due to certain drawing and anisotropic conditions present during manufacture of the cup 10, the sidewall 12 includes an upper portion having a plurality of alternating peaks 16 and valleys 18 thereon. As depicted by the cup of FIG. 1, the peaks 16 are generally higher than the adjacent valleys 18. However, as shown in FIG. 2, the drawn cup 10 may exhibit a wedge condition, wherein the valley 20 is higher than the adjacent peak 22. Inasmuch as the instant invention is not directed to producing the cup 10 itself, and methods and devices therefore are well known in the art, further details regarding the production thereof will not be further described herein.

Figure 3:
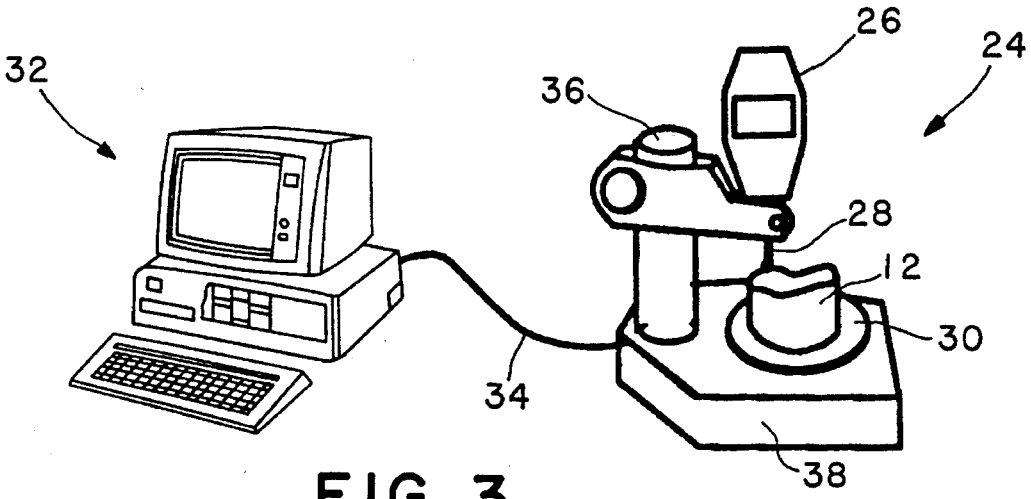
FIG. 3 depicts a cup rim height sensing device and an information processing device connected thereto in accordance with the present invention.

Referring now to FIG. 3, in accordance with the present invention, the cup 10 is placed on a height measuring device generally designated by numeral 24, which includes a cup rim height sensor 26, such as an electronic digital dial indicator, having a foot 28 adapted to ride on the rim of the sidewall 12 of the cup 10. The measuring device 24 further includes a rotating table 30 for holding the cup 10 in a proper position relative to the foot 28 and operable to rotate the cup 10 such that the foot 28 rides along the rim thereof to enable the sensor 26 to indicate the height of the rim at each location thereon. The sensor 26 is supported above the rotating table 30 by the support member 36 mounted on the base 38 of the measuring device 24. As the cup 10 is rotated, the cup rim height data is fed to an information processing device 32, such as a personal computer or the like, through the use of a cable 34 which connects the height measuring device 24 thereto. The information processing device 32 is operable to store, display and manipulate the height data, as will be explained in greater detail below, through the use of suitable software, firmware and/or logic circuits.

Figure 4:
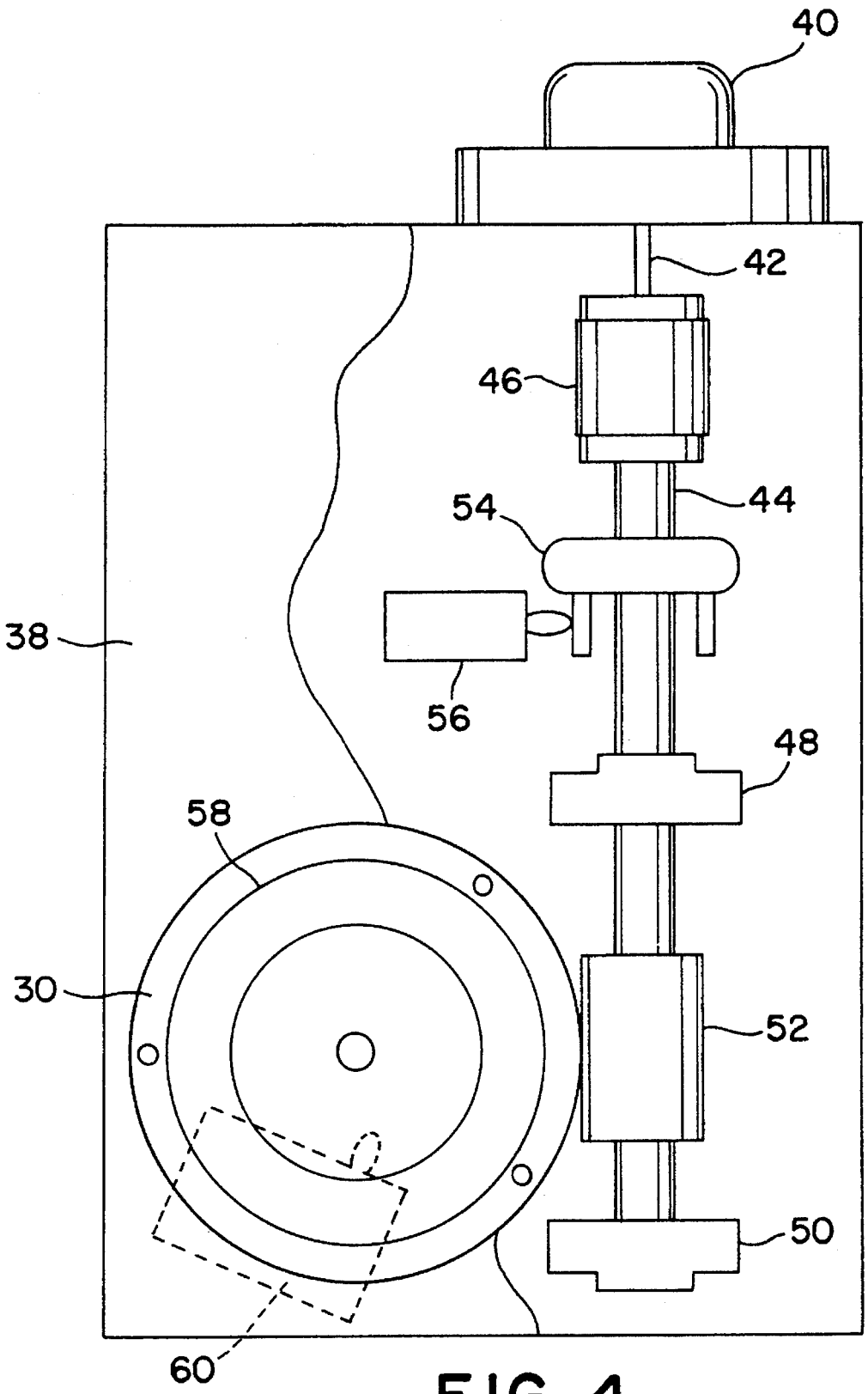
FIG. 4 depicts a partially cut-away top view of the base portion of the sensing device of FIG. 3.
Figure 5:
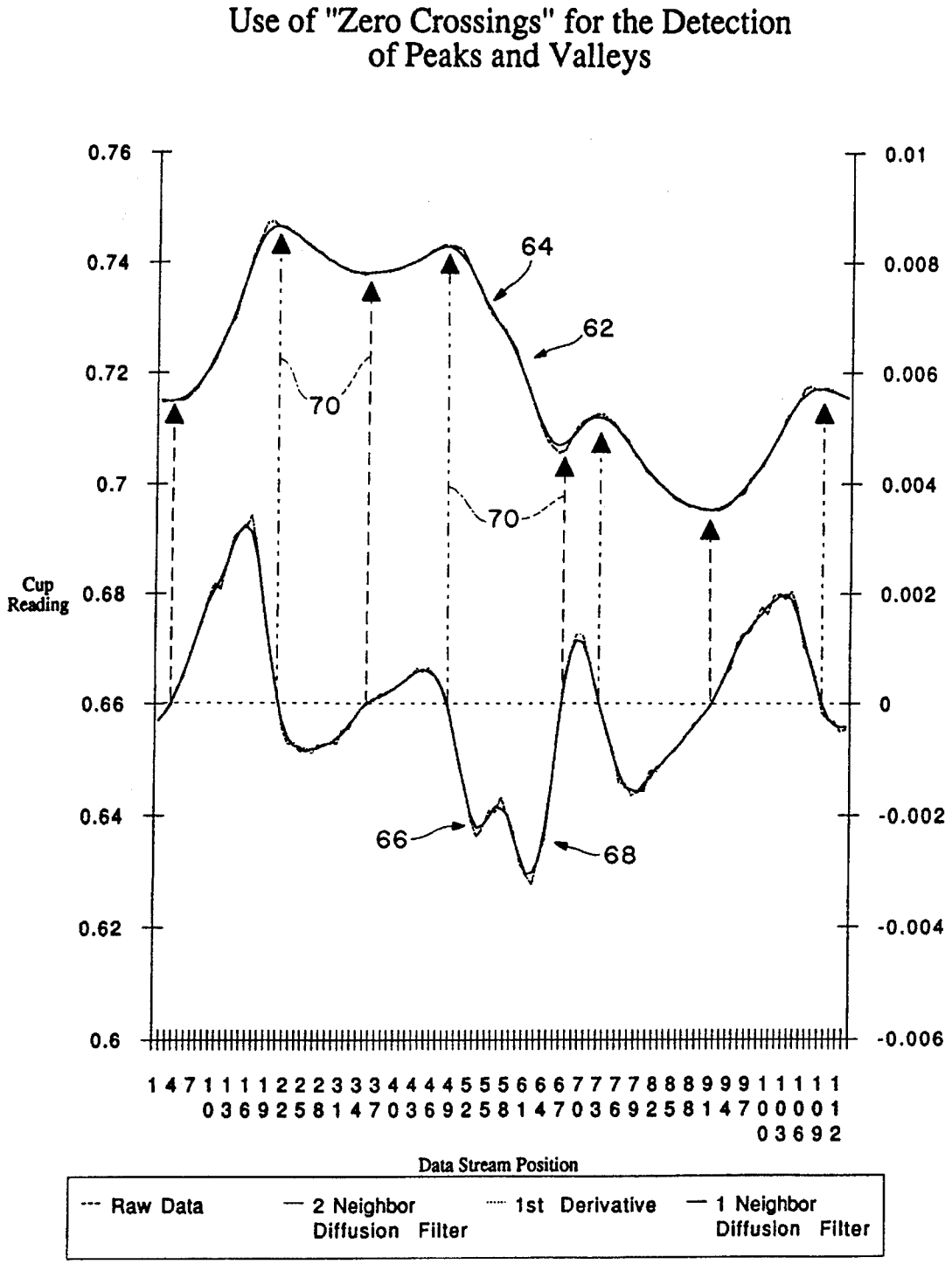
FIGS. 5 shows a exemplary graph of a cup height data set and the corresponding first derivative thereof in accordance with the present invention.

As shown in FIG. 4, the base 38 of the measuring device 24 includes a drive motor 40, preferably having a motor shaft 42 with a speed of approximately sixty revolutions per minute. The motor shaft 42 is coupled to a drive shaft 44 through the use of a suitable torsionally soft elastomeric coupling 46. The drive shaft 44 is rotatably mounted in a pair of bearing bushings 48 and 50. The drive shaft 44 includes a worm gear 52 which cooperates with a gear (not shown) on the table 30 and is operable to cause the table 30 to rotate in response to rotation of the drive shaft 44. A three lobe trigger cam 54 is provided on the drive shaft 44 and is operable to trigger a first micro switch 56, through the use of suitable electronic circuitry (not shown), to cause a cup rim height reading to be taken by the sensor 26 each time the table 30 rotates a given number of degrees. Preferably, the trigger cam 54 is calibrated to cause a rim height reading to be taken by the sensor 26 each time the cup rotates approximately 3.1 degrees. Preferably, the table 30 is provided with an indexing ring 58 which holds the cup 10 in the sensing device 26. The cup may be secured on the table 30 by placing a cylindrical magnet (not shown) inside the cup 10. The measuring device 24 further includes a second micro switch 60 mounted under the table 30 which is operable, through the use of suitable electronic circuitry (not shown), to enable detection of when the cup 10 has completed a full rotation relative to the sensor 26. Thus, the measuring device 24 enables a cup height data set to be obtained and loaded into the information processing device 32, which data set includes data values representing the height of the cup rim at various locations thereon.

Figure 7A:
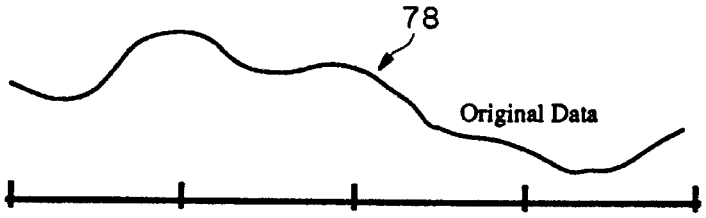
FIG. 7*a* shows a graph of an exemplary cup height data set taken from a cup having a wedge condition.
Figure 7B:
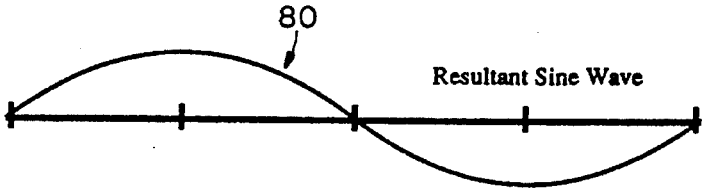
FIG. 7*b* shows the data set of FIG. 7*a* described as a sine wave.
Figure 7C:
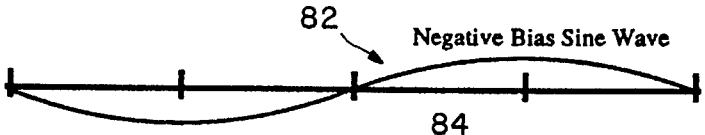
FIG. 7*c* shows a graph of an example of a negative biasing sine wave for use in biasing the data set of FIG. 7*a*.
Figure 7D:
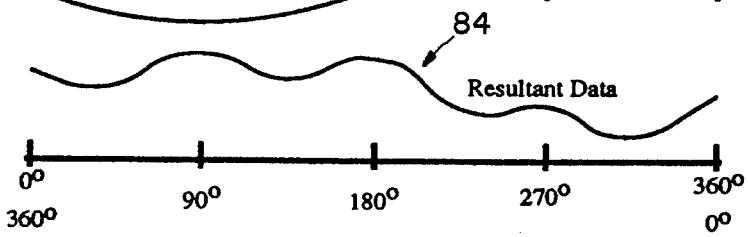
FIG. 7*d* shows a graph of the data set which results when the data sets of FIGS. 7*a* and 7*c* are combined in accordance with the present invention.
Figure 8:
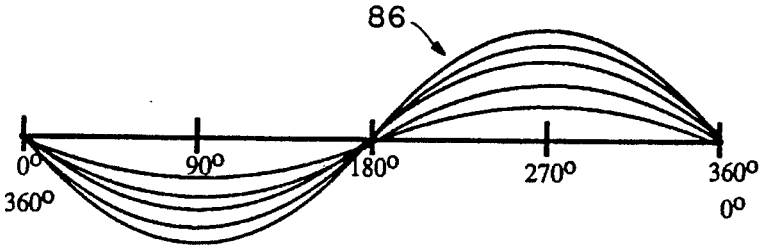
FIG. 8 shows an exemplary graph of a negative biasing sine wave with various biasing factors.
Figure 9:
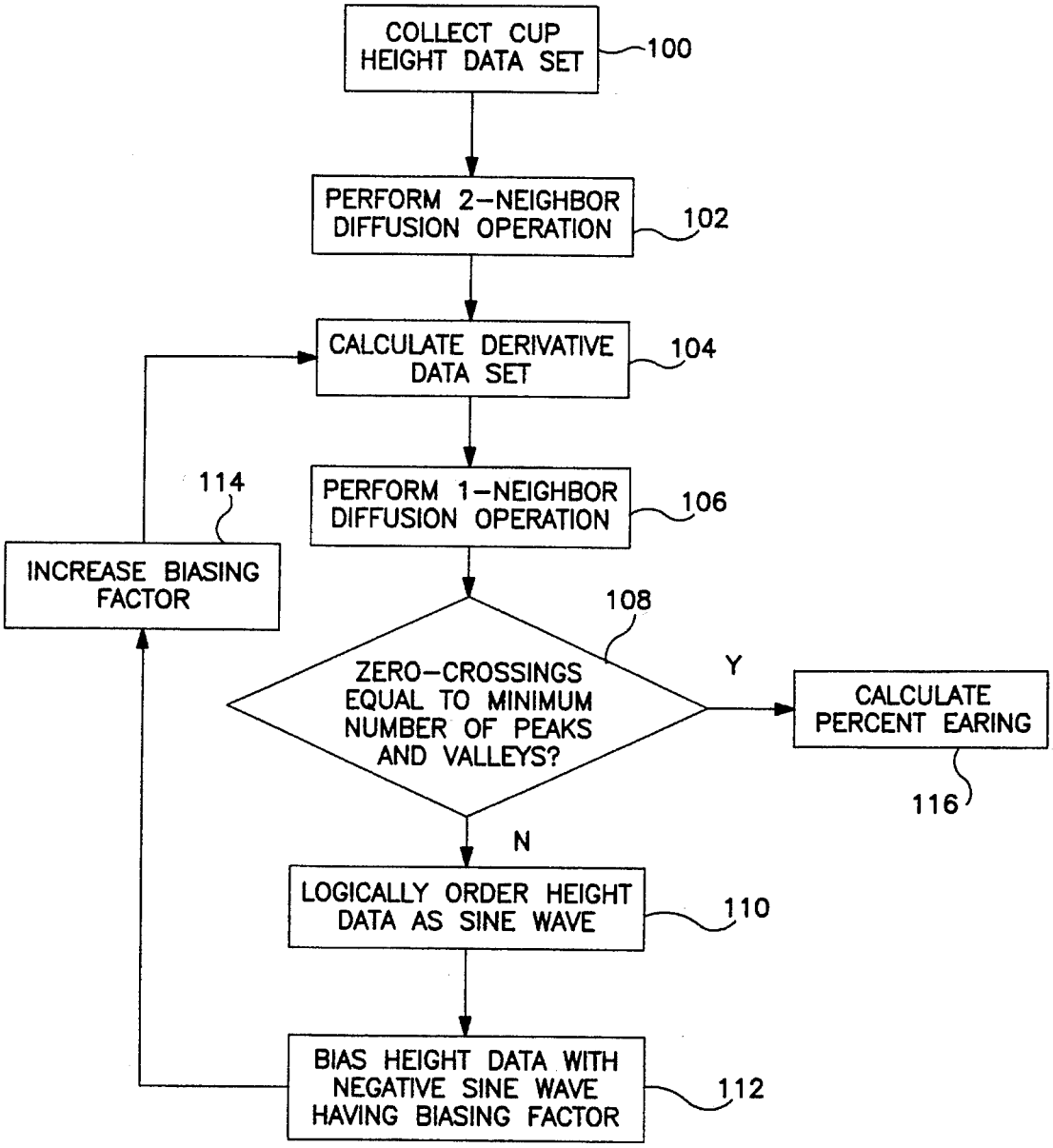
FIG. 9 is a flow chart showing a preferred embodiment of the method of the present invention.

Referring now to FIGS. 5 through 9, the method of the present invention will be hereinafter described. As indicated above, the first step in the instant method, represented by block 100 in the flow chart of FIG. 9, is to use the measuring device 24 to obtain and load into the information processing device 32 a data set including data values which represent the height of the rim of the cup 10 at particular locations thereon. A graph of the height data from a sample height data set is shown by the dashed line 62 in FIG. 5. Due to possible roughness in the cup rim, false peaks and valleys may be present in the height data set. Thus, preferably, the next step in the method, represented by block 102 in FIG. 9, is to perform a diffusion filtering operation on each of the data points in the data set. It has been found that a two-neighbor diffusion operation is typically sufficient to eliminate any false peaks or valleys in the data set, however, any other suitable number of neighboring data values may be used when filtering the data set for a particular application.

If the variable I is considered to be the location of a given data point in the data set and Value(I) is the height value of the given data point, then a one-neighbor diffusion filtering operation is performed on each data point as follows:

$$\textit{Filtered Value}(I)=(\textit{Value}(I-1)+\textit{Value}(I)+\textit{Value}(I+1))/3$$

Similarly, a two-neighbor diffusion filtering operation would average Value(I) with the two neighboring values on each side of the given data point to determine the filtered data point. The smoothing effect of the filtering operation can be seen in FIG. 5, wherein a two-neighbor filtering operation was performed on the height data 62, resulting in the filtered data set represented by the solid line 64. The filtering operation is performed by a suitable software routine in the information processing device 32.

In accordance with the present invention, the next step, represented by block 104 in FIG. 9, is to calculate the first derivative of the height data set, by taking the first derivative of each data value against its previous data value. The derivative of the height data set represented by line 64 is shown by the dotted line 66. Preferably, the derivative data set is then smoothed by performing a diffusion filtering operation thereon, as described above. It has been found that a one-neighbor filtering operation, as represented by block 106 in FIG. 9, typically provides sufficient smoothing of the derivative data set. The smoothed derivative data set is shown as solid line 68 in FIG. 5.

In accordance with one embodiment of the present invention, the percent earing is then calculated by using data values in the height data set which correspond to zero values, hereinafter referred to as "zero-crossings", in the derivative data set. In other words, by detecting zero-crossings in the derivative data set 68, the precise locations of the peaks and valleys in the height data 64 set can found and used to perform an accurate percent earing calculation. A zero-crossing going from negative to positive will indicate the location of a valley. Conversely, a zero-crossing going from positive to negative will locate a peak. The arrows 70 show the correspondence between the zero-crossings and the peaks and valleys. The percent earing for the cup is calculated, through the use of a suitable software routine, in accordance with the following formula:

$$\%\ \text{Earing} = \left[ \left( \frac{\Sigma\ \text{Peak Heights}}{\Sigma\ \text{Valley Heights}} \right) - 1 \right] * 100$$

Figure 6A:
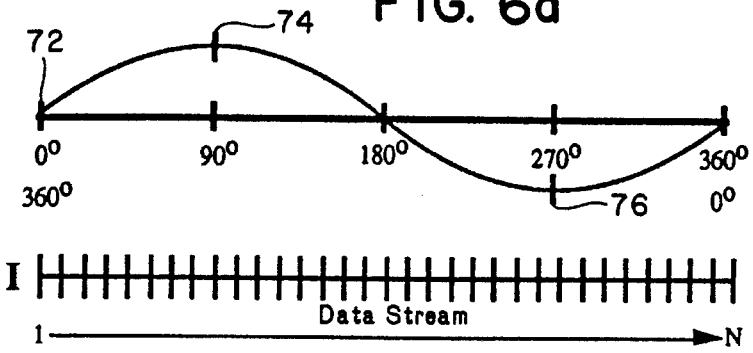
FIG. 6*a* shows a graph describing a cup having a wedge condition as a sine wave.
Figure 6B:
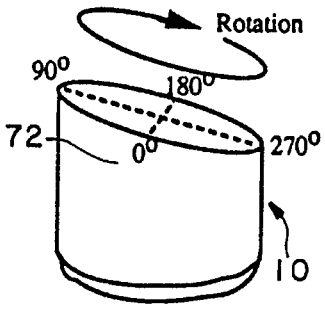
FIG. 6*b* shows a cup having a wedge condition and the location of the zero-degree position thereon determined in accordance with the present invention.

As explained above, if the cup exhibits a wedge condition, there may not be a zero-crossing in the derivative data set for each peak and valley in the height data set. Thus, in accordance with an alternative embodiment of the present invention, the number of zero-crossings are counted and compared to the known number of peaks and valleys on the cup, this step being represented by block 108 in FIG. 9. As indicated above, a typical cup of double reduced material will include four peaks and four valleys. If the number of zero-crossings in the derivative data is less than the known number of peaks and valleys on the cup, a wedge condition exists and a biasing procedure is performed on the height data set to increase the detectability thereof. The biasing procedure includes the step of ordering the height data set such that it generally corresponds to a given waveform, such as a sine wave, cosine wave or the like. This ordering step is represented by block 110 in FIG. 9. The ordering step is performed, as shown in FIGS. 6*a* and 6*b*, by defining the starting point of the data, or zero-degree position on the cup 10, using the minimum and maximum values in the data set. For example, if the data is to be ordered as a sine wave, as shown in FIG. 6*a*, the zero-degree position is ninety degrees to the left of the position in the data set of the maximum height value 74 (MaxI). The zero-degree position is also located two hundred and seventy degree to the left of the minimum height value 76 (MinI). In other words, if N is the number of data points in the data set, the zero-degree position is found as follows:

$$\text{Zero-Degree Index Position} = \begin{matrix} INT(\text{Max}I - (90*(N/360)) \\ \text{or} \\ INT(\text{Min}I - (270*(N/360)) \end{matrix}$$

Preferably, the average of the two locations found by using the minimum and the maximum positions is used as the zero-degree position in the data set. If MaxI_Index is the zero-degree position found by using the maximum value and Mini_Index is the zero-degree position found by using the minimum value, the average thereof is calculated as follows:

$$\textit{Index Position}=INT((((MaxI_Index)+(N+1)+(Mini_Index)+(N+1))/2)-(N+1))$$

It is noted that it is not necessary to physically re-order the data set to start with the index position, rather, the data set can be logically addressed in the desired order.

Once the starting point 72 of the sine wave has been located in the height data set, a data set representing a negative bias sine wave is added thereto in order to bias the height data such that the derivative data set will include a zero-crossing for each peak and valley in the height data set. This step is represented by block 112 in FIG. 9. If the height data set is ordered to correspond to a cosine wave or other waveform, then the biasing data set would correspond to a negative form of the waveform used.

In FIG. 7*a*, there is shown a height data set 78 having a wedge condition which would result in a derivative data set without a zero-crossing for each peak and valley in the data set. By ordering the data to correspond to the sine wave 80 of FIG. 7*b*, and by adding the negative biased sine wave 82 of FIG. 7*c*, the wedge condition is eliminated from the resultant data set 84 of FIG. 7*d*. In other words, due to the biasing, each of the peaks is now higher than its adjacent valleys. Thus, the derivative data set taken from the resultant data set 84, will include a zero-crossing corresponding to each of the peaks and valleys in the original data, thereby enabling a percent earing calculation, represented by block 116 in FIG. 9, to be accurately performed using the original data in the manner described above.

In accordance with the instant invention, the negative biasing waveform includes a given biasing factor which can be increased to further increase the detectability of the peaks and valleys, if necessary. For example, if a sine wave is used, the negative biased data set is calculated as follows:

$$\textit{Negative Bias}(I)=\text{Sine}((360/N)*I)*((Min_Value-Max_Value)*0.707)*Gain$$

wherein the gain is preferably increased from a value of 0.1 to 0.5, as represented by block 114 in FIG. 9, until the desired number of zero-crossings are present in the derivative data set. In other words, the biasing starts at a relatively low value and is incrementally increased just enough to enable detection of the peaks and valleys in the height data set. A negative biased sine wave 86 having a biasing factor of 0.1 to 0.5 is shown in FIG. 8.

In order to reduce the possibility of detecting false zero-crossings in the derivative data set, i.e. zero-crossings resulting from noise in the data which do not properly identify a peaks or a valley, the information processing device may be programmed to ignore a zero-crossing when counting same, if the zero-crossing occurs within a certain number of data points or degrees of a previously counted zero-crossing.

As will be apparent to one skilled in the art, all of the calculation and data manipulation steps described above are performed through the use of suitable software in the information processing device.

While the preferred forms and embodiments of the invention have been illustrated and described, it will be apparent to those of ordinary skill in the art that various changes and modifications may be made without deviating from the inventive concepts and spirit of the invention as set forth above, and it is intended by the appended claims to define all such concepts which come within the full scope and true spirit of the invention.

What is claimed is:

1. A method of testing a drawn metal cup for earing, wherein the cup includes an upper rim portion having a known minimum number of alternating peaks and valleys thereon, said method comprising the steps of:

(a) using a sensing device to obtain a first data set representing the height of the rim portion of said cup by rotating the cup relative to said sensing device and recording rim height data each time the cup rotates a given number of degrees;

(b) loading said first data set into an information processing device;

(c) generating a second data set which represents the first derivative of said first data set; and (d) calculating the percent earing for said cup from said first data set by using values in said first data set which correspond to zero-crossings in said second data set;

said step of generating said second data set including:

(e) counting the number of zero-crossings in said second data set; and (f) if said number of zero-crossings is less than the known minimum number of peaks and valleys, generating a biased first data set by adding a biasing data set thereto, wherein said biasing data set is selected to increase the detectability of the peaks and valleys in said first data set, and regenerating said second data set to represent the first derivative of said biased first data set.

2. The method as defined in claim 1, wherein said biasing data set represents a given function with a given biasing factor, and further wherein said step of generating said second data set further includes the steps of repeatedly increasing said biasing factor to further increase the detectability of the peaks and valleys in said first data set, regenerating said biased first data set, and regenerating said second data set from said biased first data set, until said number of zero crossings in said second data set equals said known minimum number of peaks and valleys.

3. The method as defined by claim 2, wherein said step of generating said biased first data set includes the steps of logically ordering said first data set to generally correspond to a given waveform, and defining said biasing data set to represent a negative form of said given waveform.

4. The method as defined by claim 3, further including the step of selecting said given waveform to be in the form of a sine wave.

5. The method as defined by claim 1, wherein said step of generating said biased first data set includes the steps of logically ordering said first data set to generally correspond to a given waveform, and defining said biasing data set to represent a negative form of said given waveform.

6. The method as defined by claim 5, further including the step of selecting said given waveform to be in the form of a sine wave.

7. The method as defined in claim 5, further including the step of smoothing said first data set prior to generating said second data set by performing a diffusion filtering operation thereon.

8. The method as defined in claim 7, further including the step of smoothing said second data set prior to calculating the percent earing by performing a diffusion filtering operation thereon.

9. The method as defined in claim 3, further including the step of smoothing said first data set prior to generating said second data set by performing a diffusion filtering operation thereon.

10. The method as defined in claim 1, further including the step of smoothing said second data set prior to calculating the percent earing by performing a diffusion filtering operation thereon.

11. The method as defined in claim 1, wherein the step of using said sensing device includes recording rim height data each time the cup rotates approximately 3.1 degrees.

12. The method as defined by claim 1, wherein said step of counting said number of zero-crossings in said second data set includes not counting zero-crossings which occur within approximately ten degrees after a zero-crossing is counted.

13. Apparatus for testing a drawn metal cup for earing, wherein the cup includes an upper rim portion having a known minimum number of alternating peaks and valleys thereon, said apparatus comprising:

a sensing device operable to obtain a first data set representing the height of the rim portion of said cup at various locations thereon; and an information processing device operable to receive said first data set, wherein said information processing device includes means for generating a second data set which represents the first derivative of said first data set, and means for calculating the percent earing for said cup from said first data set by using values in said first data set which correspond to zero-crossings in said second data set;

said means for generating said second data set including means for counting the number of zero-crossings in said second data set; and means for generating a biased first data set, if said number of zero-crossings is less than the known minimum number of peaks and valleys, by adding a biasing data set thereto, wherein said biasing data set is selected to increase the detectability of the peaks and valleys in said first data set, and means for regenerating said second data set to represent the first derivative of said biased first data set.

14. The apparatus defined in claim 13, wherein said biasing data set represents a given function with a given biasing factor, and further wherein said means for generating said second data set further includes means for repeatedly increasing said biasing factor to further increase the detectability of the peaks and valleys in said first data set, regenerating said biased first data set and regenerating said second data set from said biased first data set, until said number of zero crossings in said second data set equals said known minimum number of peaks and valleys.

15. The apparatus defined by claim 14, wherein said means for generating said biased first data set includes means for logically ordering said first data set to generally correspond to a given waveform, and means for defining said biasing data set to represent a negative form of said given wave form.

16. The apparatus defined by claim 15, further including means for defining said given waveform to be in the form of a sine wave.

17. The apparatus defined by claim 13, wherein said means for generating said biased first data set further includes means for logically ordering said first data set to generally correspond to a given waveform, and means for defining said biasing data set to represent a negative form of said given waveform.

18. The apparatus defined by claim 17, further including means for defining said given waveform to be in the form of a sine wave.

19. The apparatus defined in claim 17, further including means for smoothing said first data set prior to generating said second data set by performing a diffusion filtering operation thereon.

20. The apparatus defined in claim 19, further including means for smoothing said second data set prior to calculating the percent earing by performing a diffusion filtering operation thereon.

21. The apparatus defined in claim 13, further including means for smoothing said first data set prior to generating said second data set by performing a diffusion filtering operation thereon.

22. The apparatus defined in claim 13, further including means for smoothing said second data set prior to calculating the percent earing by performing a diffusion filtering operation thereon.

23. The apparatus defined in claim 13, wherein said sensing device includes means for rotating said cup relative to said sensing device and means for recording rim height data each time the cup rotates approximately 3.1 degrees.

24. The apparatus as defined by claim 23, wherein said sensing device further includes means for determining when said cup has completed a full rotation relative to said sensing device.

25. The apparatus defined by claim 13, wherein said means for counting said number of zero-crossings in said second data set includes means for not counting zero-crossings which occur within approximately ten degrees after a zero-crossing is counted.

* * * * *

UNITED STATES PATENT AND TRADEMARK OFFICE

CERTIFICATE OF CORRECTION

PATENT NO. : 5,485,387

DATED : Jan. 16, 1996

INVENTOR(S) : Eric M. FRANKE-POLZ

It is certified that error appears in the above-indentified patent and that said Letters Patent is hereby corrected as shown below:

Column 6, Line 12, in the formula beginning with the words "Index Position," delete the word "Mini" and insert -- MinI --.

Column 8, Line 3 (Claim 9), after the word "claim" delete "3" and insert -- 1 --.

Signed and Sealed this

Eighteenth Day of June, 1996

Bruce Lehman

*Attest:*

BRUCE LEHMAN

*Attesting Officer*

*Commissioner of Patents and Trademarks*